US008243974B2

(12) United States Patent
Cheng

(10) Patent No.: US 8,243,974 B2
(45) Date of Patent: Aug. 14, 2012

(54) WIRELESS MICROPHONE

(75) Inventor: Sue Cheng, Chiayi County (TW)

(73) Assignee: Mipro Electronics Co., Ltd., Chiayi (TW)

( * ) Notice: Subject to any disclaimer, the term of this patent is extended or adjusted under 35 U.S.C. 154(b) by 309 days.

(21) Appl. No.: 12/756,383

(22) Filed: Apr. 8, 2010

(65) Prior Publication Data

US 2011/0249852 A1 Oct. 13, 2011

(51) Int. Cl.
*H04R 9/08* (2006.01)

(52) U.S. Cl. ..... 381/355

(58) Field of Classification Search ..... 381/355, 381/361; 362/203; D14/144, 228
See application file for complete search history.

(56) References Cited

U.S. PATENT DOCUMENTS

| | | | | |
|---|---|---|---|---|
| 4,910,795 | A * | 3/1990 | McCowen et al. | 455/95 |
| 6,463,159 | B1 * | 10/2002 | Ming-Cheng | 381/355 |
| 6,769,787 | B2 * | 8/2004 | Ferguson et al. | 362/203 |
| 6,968,070 | B1 * | 11/2005 | Chiang | 381/361 |
| 7,801,316 | B2 * | 9/2010 | Akino | 381/174 |
| 7,974,429 | B2 * | 7/2011 | Tsai | 381/361 |
| 2001/0004318 | A1 * | 6/2001 | Pitts | 362/84 |

* cited by examiner

*Primary Examiner* — Jianchun Qin
(74) *Attorney, Agent, or Firm* — Renner, Otto, Boisselle, Sklar, LLP

(57) ABSTRACT

A wireless microphone includes a grip that includes a barrel. The barrel includes a barrel body that is configured with a battery receiving space and that has one side formed with a cutout for access to the battery receiving space. The grip further includes a lid coupled to the barrel body and operable to a closing state for closing the cutout. The grip also includes an external thread formed on the barrel and the lid and constituted by a first thread part on the barrel and a second thread part on the lid. The wireless microphone further includes a retainer configured for threaded connection to the external thread to retain the lid in the closing state.

11 Claims, 6 Drawing Sheets

WIRELESS MICROPHONE

BACKGROUND OF THE INVENTION

1. Field of the Invention

The invention relates to a wireless microphone, and more particularly to a wireless microphone that includes a removable battery.

2. Description of the Related Art

A wireless microphone may fail to securely hold a battery, and installation of the battery may involve an inconvenient user operation. For example, in FIG. 1, ROC Patent Publication Number 19963 discloses a wireless microphone with a cover 10 that is sheathed over a battery holder 11. In FIG. 2, ROC Patent Publication Number 40886 discloses another battery holder 20 into which a user may slide one or more batteries against an opposing force of a spring 23. Each of the battery holders 11, 20 of FIG. 1 and FIG. 2 may allow an installed battery to shift within the respective battery holder 11, 20 during movement of the respective wireless microphone. Movement of each battery within its respective battery holder 11, 20 may generate transient electrical effects or interrupt power delivery, affecting operation of the respective wireless microphone.

SUMMARY OF THE INVENTION

The main object of the present invention is to provide convenient and secure battery installation for a wireless microphone.

Accordingly, a wireless microphone of this invention includes a grip that includes a barrel. The barrel includes a barrel body that is configured with a battery receiving space and that has one side formed with a cutout for access to the battery receiving space. The grip further includes a lid coupled to the barrel body and operable to a closing state for closing the cutout. The grip also includes an external thread formed on the barrel and the lid and constituted by a first thread part on the barrel and a second thread part on the lid. The wireless microphone further includes a retainer configured for threaded connection to the external thread to retain the lid in the closing state.

An advantage of the present invention includes improved installation of the battery into the battery receiving space through the cutout of the barrel body, and fixation of the battery within the battery receiving space when the lid is at the closing state and the retainer is engaged in threaded connection with the external thread to retain the lid in the closing state.

BRIEF DESCRIPTION OF THE DRAWINGS

Other features and advantages of the present invention will become apparent in the following detailed description of the preferred embodiment with reference to the accompanying drawings, of which.

DETAILED DESCRIPTION OF THE PREFERRED EMBODIMENT

Figure 1:
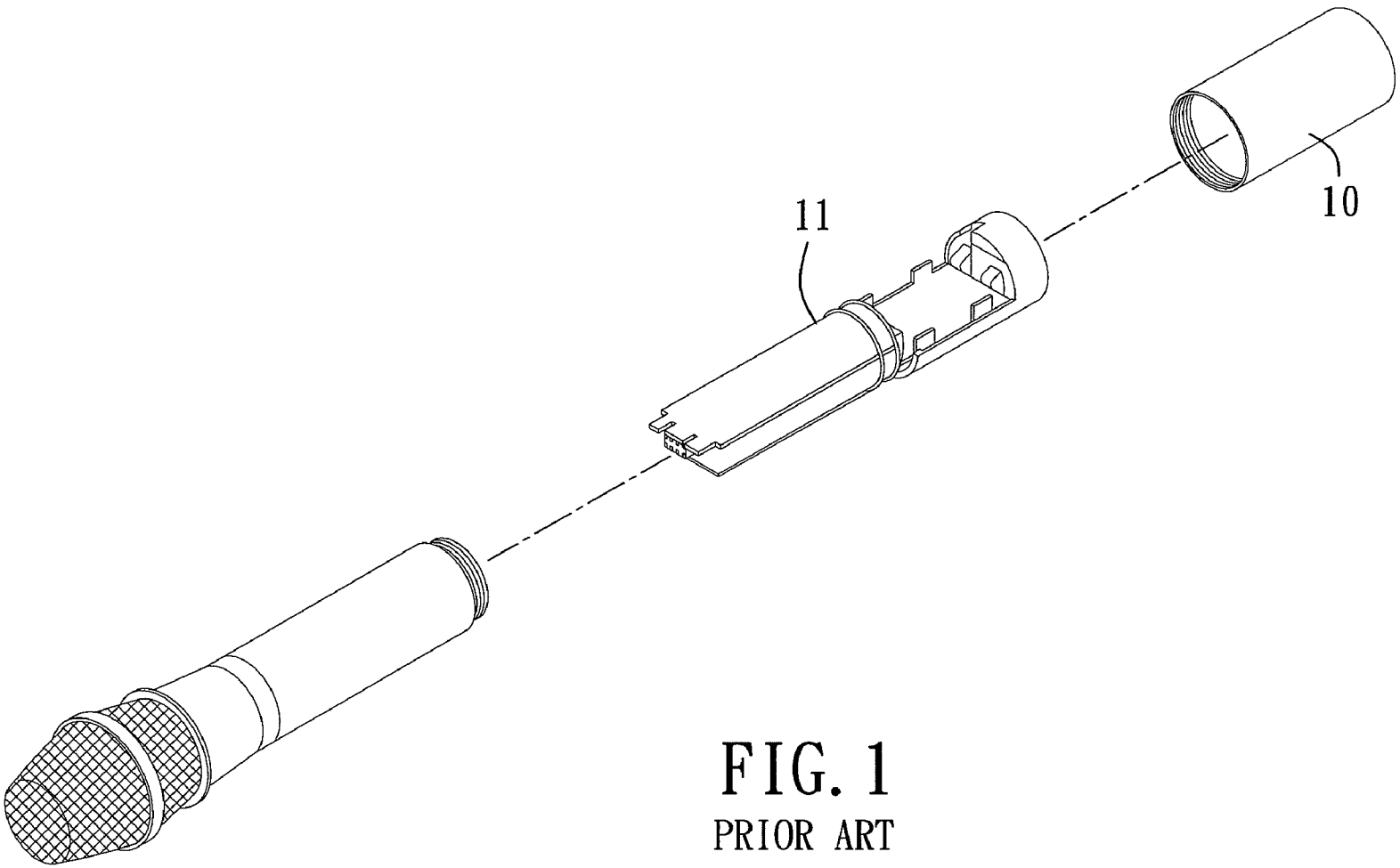
FIG. 1 PRIOR ART
FIG. 1 is an exploded perspective view of a conventional microphone.
Figure 2:
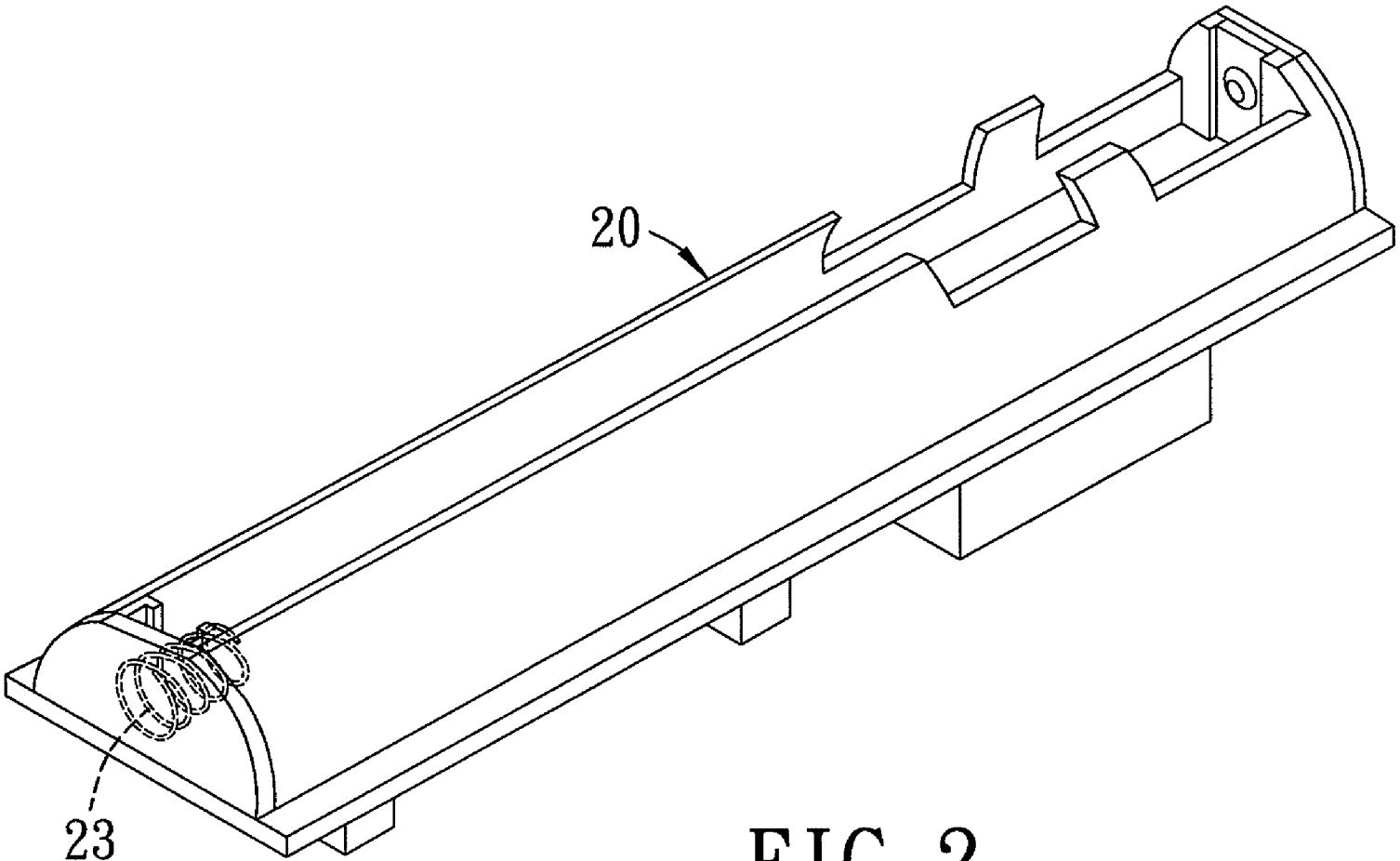
FIG. 2 PRIOR ART
FIG. 2 is an enlarged perspective view of a battery holder of another conventional microphone.
Figure 3:
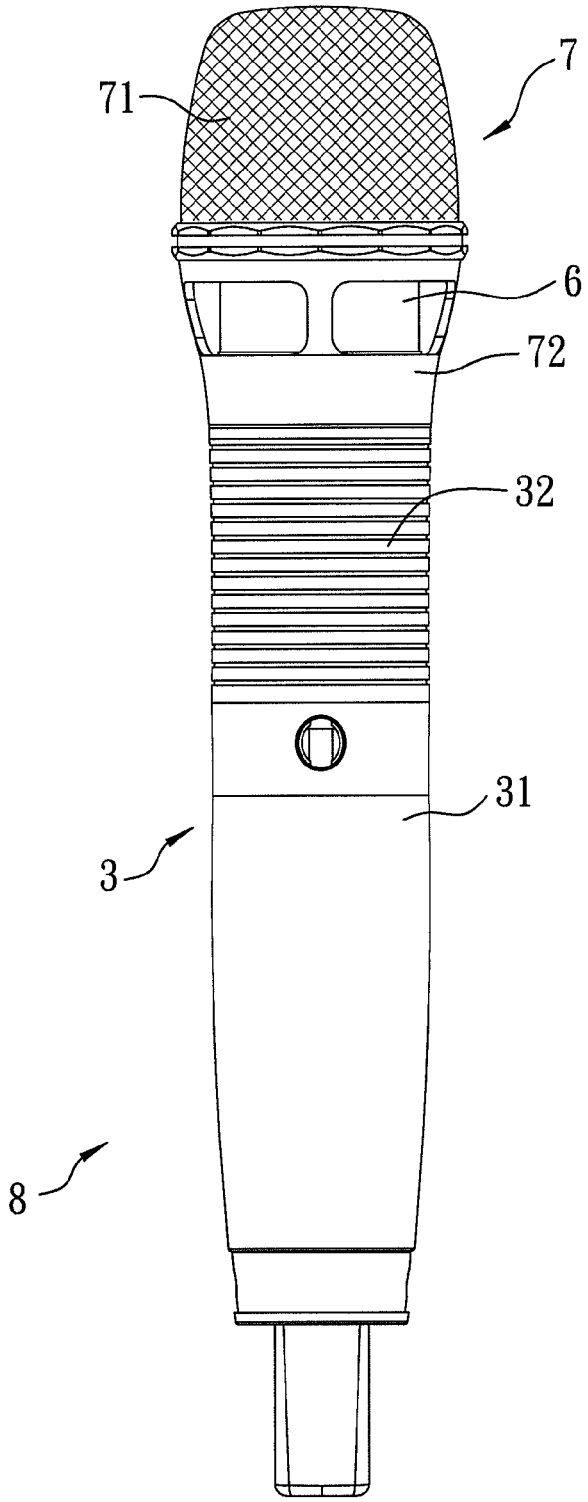
FIG. 3 is a view of a wireless microphone according a preferred embodiment of the present invention.
Figure 4:
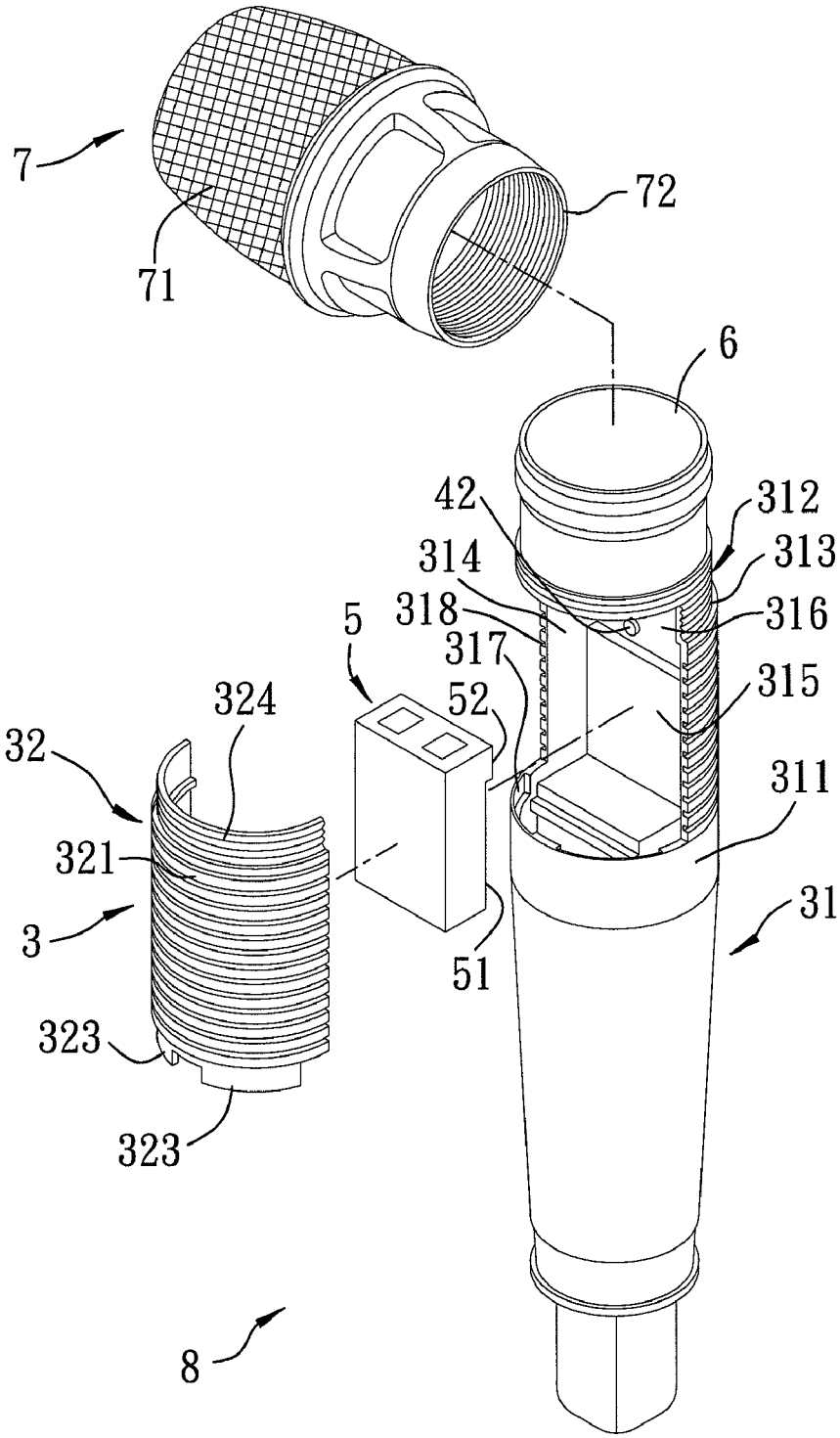
FIG. 4 is a partially exploded perspective view of the preferred embodiment.
Figure 5:
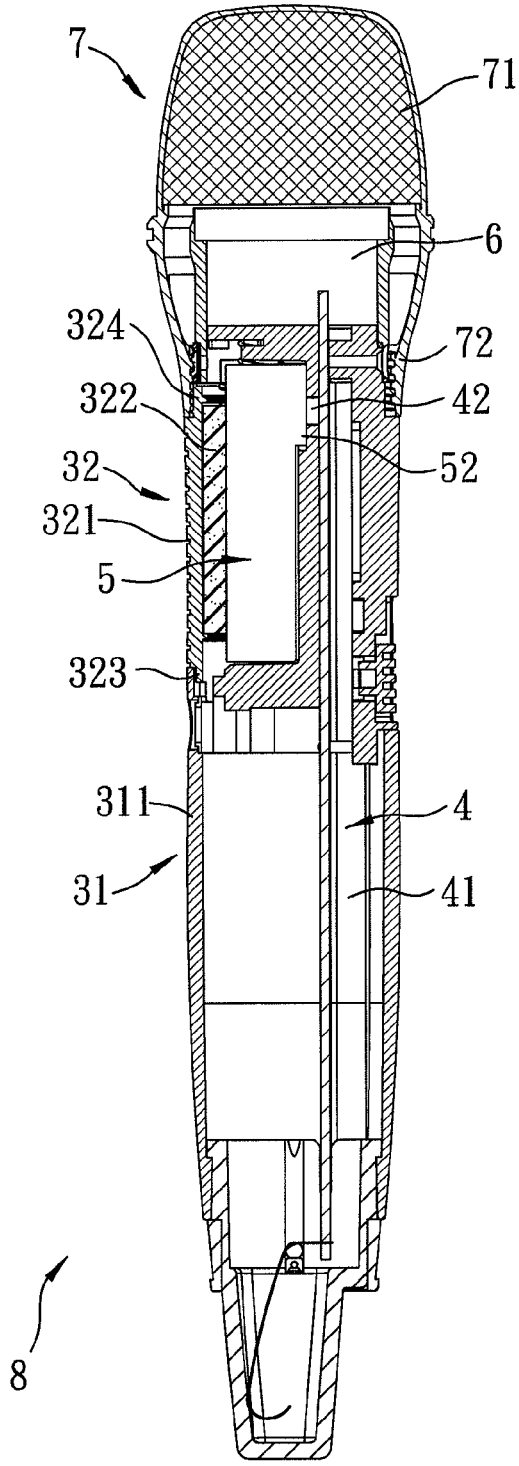
FIG. 5 is a sectional view of the preferred embodiment.

Referring to FIGS. 3 to 5, the preferred embodiment of a wireless microphone 8 according to the present invention is shown to include a grip 3 having an upright cylindrical shape, a charging unit 4 and a battery 5 disposed in the grip 3, an audio pick-up unit 6 disposed on top of the grip 3, and a retainer 7 disposed on top of the grip 3.

Figure 6:
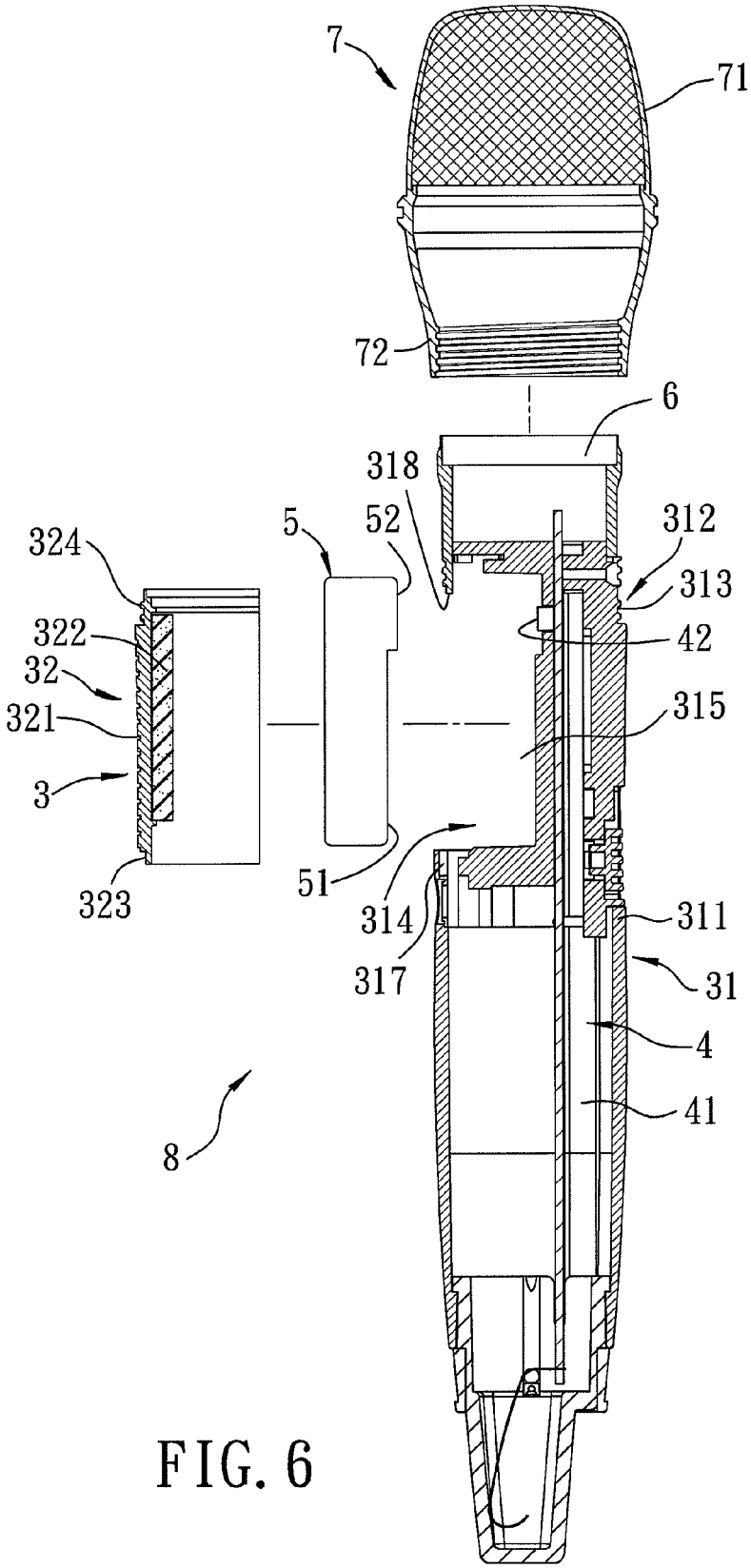
FIG. 6 is a partially exploded sectional view of the preferred embodiment.

Referring to FIGS. 4 to 6, the grip 3 includes a barrel 31 and a lid 32 that engage each other and cooperate to form a cylindrical shape. The barrel 31 includes an elongated barrel body 311 that is configured with a battery receiving space 314 and that has one side formed with a cutout 318 for access to the battery receiving space 314. The barrel 31 is further formed with a plurality of recesses 317 at an inner side proximate to a bottom edge of the cutout 318. An external thread 313 is formed on the barrel 31 and the lid 32 and constituted by a first thread part 312 on the barrel 31 and a second thread part 324 on the lid 32. In this embodiment, a pair of recesses 317 are spaced apart from each other and formed in a wall of the battery receiving space 314 distal from the first thread part 312. The battery receiving space 314 includes a battery abutment wall 315 that confronts the battery receiving space 314 and that is formed with an indentation 316.

The lid 32 has a lid body 321 that may be coupled to the barrel body 311 and operated to a closing state for closing the cutout 318 in the barrel body 311 and covering the battery receiving space 314. The lid 32 includes an abutment part 322 mounted adhesively on an inner lateral side of the lid body 321 for abutting against the battery 5 to fix the battery 5 in the battery receiving space 314. When the lid 32 is at a closed state, the abutment part 322 may fix the battery 5 in the battery receiving space 314 by clamping the battery 5 between the abutment part 322 and the battery abutment wall 315 to limit movement of the battery 5 away from the battery abutment wall 315. In this embodiment, the abutment part 322 is a resilient cushion. In variations of the preferred embodiment, the abutment part 322 may be rigid, flexible, or resilient, and may be composed of a protruding part, a brace, a spring, or other structures.

The lid 32 is further formed with a plurality of insert tabs 323 that extend from a bottom edge of the lid body 321 into the recesses 317. The lid 32 is also formed with the second thread part 324 that extends from a top edge of the lid body 321 to abut against and combine with the first thread part 312 on the barrel 31 for forming the external thread 313. In variations of the preferred embodiment, the external thread 313 may be continuous or it may be broken by one or more gaps. In this embodiment, the number of the insert tabs 323 of the lid 32 is identical to the number of the recesses 317, and each of the insert tabs 323 may engage a respective recess 317.

The charging unit 4 is disposed in the barrel body 311, and includes a charger 41 and an actuator 42 coupled operatively to the charger 41. The actuator 42 is mounted to the battery abutment wall 315 and may be actuated by the battery 5 for enabling operation of the charger 41 in a charging mode for transmitting power to the battery 5. In this embodiment, the actuator 42 is a press button switch that extends into the indentation 316. In variations of the preferred embodiment, the actuator 42 may include an operable part that is moved or an electrical contact that is engaged to enable operation of the charger 41.

The battery 5 has a battery surface 51 for abutting against the battery abutment wall 315. The battery 5 is formed with a protrusion 52 for removably engaging the indentation 316. In this embodiment, the protrusion 52 has a rectangular shape, but in variations of the preferred embodiment, the protrusion 52 may take a circular form or any other protruding shape.

When the wireless microphone 8 is in a chargeable state, and the protrusion 52 of the battery 5 presses the actuator 42 of the charging unit 4, charging operation of the charger 41 is enabled for supplying power to the battery 5. Correspondence between the shapes of the protrusion 52 and the indentation 316 allows the battery 5 to actuate the actuator 42 and confirms that the battery 5 has a compatible specification with the charging unit 4, which prevents a battery 5 of an incompatible specification from damaging the wireless microphone 8.

The audio pick-up unit 6 is disposed at a top end of the barrel 31 of the grip 3 for picking up ambient sound signals. Since the feature of this invention does not reside in the audio pick-up unit 6, the audio pick-up unit 6 is not further described hereinafter.

The retainer 7 includes a perforated cap 71 to be sheathed over the top end of the grip 3. The retainer 7 further includes an internally threaded part 72 that extends from the perforated cap 71. The perforated cap 71 masks the exterior portion of the audio pick-up unit 6 for protection from accidental impact. The internally threaded part 72 is used for threaded connection to the external thread 313 formed by the second thread part 324 and the first thread part 312 of the grip 3. When the internally threaded part 72 is engaged in threaded connection with the external thread 313, the first thread part 312 and the second thread part 324 are locked together to secure the battery 5 in the battery receiving space 314. In variations of the preferred embodiment, the internal threaded part 72 may have continuous or broken threads.

In order to place the battery 5 in the battery receiving space 314, the internally threaded part 72 of the retainer 7 may be unscrewed from the external thread 313. This unlocks the first thread part 312 and the second thread part 324, allowing the lid 32 to be moved to an opening state to uncover the cutout 318 and permitting access to the battery receiving space 314. The insert tabs 323 of the lid 32 may be removed from the recesses 317, allowing the lid 32 to be separated from the barrel 31 of the grip 3.

The battery 5 may then be inserted into the battery receiving space 314 with the protrusion 52 facing the indentation 316. Correspondence between the shapes of the battery 5 and the battery receiving space 314 and between the shapes of the protrusion 52 and the indentation 316 allows the battery 5 to actuate the actuator 42 and prevents insertion of an unsuitable battery 5 that may damage the wireless microphone 8. In addition, correspondence between the indentation 316 and the protrusion 52 prevents rotation or translation of the battery 5 relative to the grip 3.

After the battery 5 is mounted in the battery receiving space 314, the insert tabs 323 of the lid 32 are extended into the recesses 317, and the lid body 321 of the lid 32 is moved to a closing state to cover the battery receiving space 314. Closing the lid 32 also merges the first thread part 312 with the second thread part 324 to form the external thread 313. The internally threaded part 72 of the retainer 7 is then engaged in threaded connection with the external thread 313, locking the first thread part 312 with the second thread part 324, securing the lid 32 and fixing the battery 5 within the battery receiving space 314. Once secured, the lid 32 clamps the battery 5 between the abutment part 322 and the battery abutment wall 315 to limit movement of the battery 5 away from the battery abutment wall 315 and to increase stability of the battery 5 within the barrel body 311 of the grip 3. Even if the wireless microphone 8 of this invention is shaken, the battery 5 remains firmly fixed in the battery receiving space 314, which prevents transient electrical effects or a discontinuous supply of power.

Removal of the battery 5 from the battery receiving space 314 may be performed without the use of tools by reversing the installation steps described above. For example, the retainer 7 may be unscrewed from the grip 3 to release the lid 32 from the barrel 31 of the grip 3. This permits access to the battery 5 within the battery receiving space 314 for dismounting operations.

In summary, in the present invention, by extending the insert tabs 323 of the lid 32 into the recesses 317 and operating the lid 32 to the closing state, the second thread part 324 of the lid 32 is aligned with the first thread part 312 to form the external thread 313. The internally threaded part 72 of the retainer 7 may then be engaged with the external thread 313 to lock the lid 32 in place. Locking the lid 32 at the closing state covers the battery receiving space 314 and also secures the battery 5 within the battery receiving space 314 by causing the abutment part 322 to press the battery 5. Accordingly, when the wireless microphone 8 is shaken, transient electrical effects or discontinuous power supply attributed to movement of the battery 5 relative to the grip 3 are prevented.

In addition, mounting and dismounting the battery 5 without the use of tools is permitted by the threaded connection between the internally threaded part 72 of the retainer 7 and the external thread 313 of the grip 3. Moreover, by checking for actuation of the actuator 42 when a compatibly shaped protrusion 52 of the battery 5 is inserted into the indentation 316 of the battery receiving space 314, damage to the wireless microphone from operation using an incompatible battery is prevented.

While the present invention has been described in connection with what is considered the most practical and preferred embodiment, it is understood that this invention is not limited to the disclosed embodiment but is intended to cover various arrangements included within the spirit and scope of the broadest interpretation to encompass all such modifications and equivalent arrangements.

What is claimed is:

1. A wireless microphone, comprising:

a grip that includes a barrel including a barrel body that is configured with a battery receiving space therein and that has one side formed with a cutout for access to said battery receiving space, a lid coupled to said barrel body and operable to a closing state for closing said cutout, and an external thread formed on said barrel and said lid and constituted by a first thread part on said barrel and a second thread part on said lid; and a retainer configured for threaded connection to said external thread to retain said lid in the closing state.

2. The wireless microphone as claimed in claim 1, wherein one of said barrel and said lid is formed with an insert tab, and the other of said barrel and said lid is formed with a recess configured to receive said insert tab when said lid is in the closing state.

3. The wireless microphone as claimed in claim 1, wherein said retainer includes a perforated cap for covering an end of said grip, and an internally threaded part that extends from said perforated cap and that engages threadedly said external thread.

4. The wireless microphone as claimed in claim 1, further comprising a battery, said lid further including an abutment part disposed on said lid for abutting against and releasably fixing said battery in said battery receiving space.

5. The wireless microphone as claimed in claim 4, wherein said abutment part is a resilient cushion.

6. The wireless microphone as claimed in claim 4, wherein said barrel body includes a battery abutment wall that confronts said battery receiving space and that is formed with an indentation, said battery having a battery surface for abutting against said battery abutment wall, said battery surface being formed with a protrusion for engaging removably said indentation.

7. The wireless microphone as claimed in claim 6, further comprising a charging unit disposed in said barrel body, said charging unit including a charger and an actuator coupled operatively to said charger, said actuator being mounted to said battery abutment wall and being actuated by said battery in said battery receiving space for enabling operation of said charger in a charging mode for transmitting power to said battery.

8. The wireless microphone as claimed in claim 7, wherein said actuator is a press button switch that extends into said indentation.

9. The wireless microphone as claimed in claim 4, further comprising a charging unit disposed in said barrel body, said charging unit including a charger and an actuator coupled operatively to said charger, said actuator being actuated by said battery in said battery receiving space for enabling operation of said charger in a charging mode for transmitting power to said battery.

10. The wireless microphone as claimed in claim 9, wherein said actuator is a press button switch.

11. The wireless microphone as claimed in claim 1, wherein said lid is formed with a pair of insert tabs, and said barrel is formed with a pair of recesses each configured to receive a respective one of said insert tabs when said lid is in the closing state.

* * * * *